US007938126B2

(12) United States Patent
Matsufuji et al.

(10) Patent No.: US 7,938,126 B2
(45) Date of Patent: May 10, 2011

(54) LOW IGNITION PROPENSITY CIGARETTE

(75) Inventors: Takaaki Matsufuji, Yokohama (JP); Takeo Tsutsumi, Yokohama (JP)

(73) Assignee: Japan Tobacco Inc., Tokyo (JP)

( * ) Notice: Subject to any disclaimer, the term of this patent is extended or adjusted under 35 U.S.C. 154(b) by 935 days.

(21) Appl. No.: 10/837,763

(22) Filed: May 4, 2004

(65) Prior Publication Data

US 2004/0200493 A1 Oct. 14, 2004

Related U.S. Application Data

(63) Continuation of application No. PCT/JP02/10962, filed on Oct. 22, 2002.

(30) Foreign Application Priority Data

Nov. 5, 2001 (JP) ..... 2001-339370

(51) Int. Cl.
*A24D 1/00* (2006.01)

(52) U.S. Cl. ..... 131/364; 131/360

(58) Field of Classification Search ..... 131/364, 131/360

See application file for complete search history.

(56) References Cited

U.S. PATENT DOCUMENTS

| | | | | | |
|---|---|---|---|---|---|
| 3,604,429 | A | * | 9/1971 | De Witt | 131/65 |
| 4,037,608 | A | * | 7/1977 | Wahle | 131/84.4 |
| 4,328,817 | A | * | 5/1982 | Naylor et al. | 131/360 |
| 4,538,626 | A | * | 9/1985 | Hinzmann | 131/84.4 |
| 4,595,024 | A | * | 6/1986 | Greene et al. | 131/77 |
| 4,700,726 | A | * | 10/1987 | Townsend et al. | 131/364 |
| 4,716,913 | A | * | 1/1988 | Brackmann | 131/364 |
| RE32,615 | E | * | 3/1988 | Luke | 131/361 |
| 4,730,628 | A | * | 3/1988 | Townsend et al. | 131/364 |
| 4,838,286 | A | * | 6/1989 | Phelpstead | 131/360 |
| 4,844,100 | A | * | 7/1989 | Holznagel | 131/84.1 |
| 4,941,485 | A | * | 7/1990 | Perfetti et al. | 131/365 |
| 4,986,287 | A | * | 1/1991 | Schneider et al. | 131/360 |
| 5,003,996 | A | * | 4/1991 | Tallier et al. | 131/84.2 |
| 5,085,232 | A | * | 2/1992 | Raker et al. | 131/365 |
| 5,105,835 | A | * | 4/1992 | Drewett et al. | 131/349 |
| 5,141,003 | A | * | 8/1992 | Dawson et al. | 131/108 |
| 5,499,636 | A | * | 3/1996 | Baggett et al. | 131/374 |
| 5,586,565 | A | * | 12/1996 | Babey et al. | 131/84.2 |
| 5,617,881 | A | * | 4/1997 | Kossmehl et al. | 131/328 |
| 5,713,377 | A | * | 2/1998 | Gerding et al. | 131/364 |
| 5,722,432 | A | * | 3/1998 | Luke et al. | 131/349 |
| 5,915,388 | A | * | 6/1999 | Bowen et al. | 131/336 |
| 6,360,751 | B1 | * | 3/2002 | Fagg et al. | 131/84.4 |
| 2002/0185143 | A1 | * | 12/2002 | Crooks et al. | 131/365 |
| 2005/0066985 | A1 | * | 3/2005 | Borschke et al. | 131/360 |

FOREIGN PATENT DOCUMENTS

| | | | |
|---|---|---|---|
| DE | 19703003 | A1 | 7/1998 |
| EP | 0528186 | A1 | 2/1993 |
| JP | 49-3678 | A | 1/1974 |
| JP | 05-076335 | A | 2/1992 |
| JP | 11-046744 | A | 2/1999 |
| JP | 11-318416 | A | 11/1999 |

* cited by examiner

*Primary Examiner* — Matthew J Daniels
*Assistant Examiner* — Russell J Kemmerle, III
(74) *Attorney, Agent, or Firm* — Birch, Stewart, Kolasch & Birch, LLP

(57) ABSTRACT

A low ignition propensity cigarette according to the invention includes a high-density region formed in the center of the paper tube and containing normal shred tobacco filled to be a filling density of 0.15 to 0.35 g/cm$^3$, for example 0.25 g/cm$^3$, and a low density region formed between the paper tube and the high-density region and containing expanded shred tobacco filled to a filling density of 0.05 to 0.15 g/cm$^3$, for example 0.14 g/cm$^3$. The thickness of the low-density region defined between the paper tube and the high-density region is in the range of 1 to 3 mm.

14 Claims, 7 Drawing Sheets

LOW IGNITION PROPENSITY CIGARETTE

This application is a Continuation of PCT International Application No. PCT/JP02/10962 filed on Oct. 22, 2002 under 35 U.S.C. §371. The entire contents of each of the above-identified applications are hereby incorporated by reference. This application also claims priority of Application No. 2001-339370 filed in Japan on Nov. 5, 2001 under 35 U.S.C. §119.

TECHNICAL FIELD

The present invention relates to a low ignition propensity cigarette that has a reduced propensity to ignite a combustible object such as a floor when the cigarette in an ignited state falls onto the combustible object.

BACKGROUND ART

While a smoker is smoking an ignited cigarette, a burning cone of the ignited cigarette needs to be maintained, namely prevented from stopping burning also between the smoker's drawing-in actions, or so-called puffs. Thus, even if intervals between puffs are somewhat longer, the smoker can smoke the ignited cigarette repeatedly.

However, if the ignited cigarette falls onto a combustible object such as a floor due to the smoker's carelessness, free combustion of the ignited cigarette may cause burning of the combustible object. Hence in tobacco industry, development of a so-called low ignition propensity cigarette (hereinafter referred to simply as "cigarette"), namely a cigarette that can hold down the risk of ignition of a combustible object in the above-described situation is demanded.

In order to meet this demand, for example Japanese Unexamined Patent Publication No. hei 11-46744 and Japanese Unexamined Patent Publication No. hei 11-318416 have proposed cigarettes of this type. In the cigarette proposed in the former publication, a paper tube that wraps shred tobacco has a plurality of air barrier zones for reducing permeation of air. These air barrier zones are arranged in the longitudinal direction of the cigarette at predetermined intervals. When this cigarette is in free combustion and the burning cone of the cigarette reaches one of the air barrier zones, the air barrier zone reduces supply of air to the burning cone, and thereby stops burning of the burning cone. Thus, the risk of the ignited cigarette igniting another object is held down.

The paper tube of the cigarette proposed in the latter publication has heat conduction strips on its inner surface. The heat conduction strips extends in the axial direction of the paper tube. It is thought that when this cigarette is in free combustion, the heat conduction strip draws heat from the burning cone and thereby lowers the temperature of the burning cone. Thus, like the above-described air barrier zones, the heat conduction strip stops burning of the burning cone.

A cigarette disclosed in Japanese Unexamined Patent Publication No. hei 5-76335 can reduce sidestream smoke produced between puffs. Inside the paper tube, the cigarette has puff pockets containing shred tobacco, and inter-puff pockets containing materials other than tobacco. The puff pockets and inter-puff pockets are alternately arranged in the longitudinal direction of the cigarette. A fuse connects the puff pockets and the inter-puff pockets with one another, and thereby maintains smoldering between puffs. It is thought that also in this cigarette, the inter-puff pockets lower the temperature of the burning cone, so that the risk of the ignited cigarette igniting another object is held down.

However, any of the cigarettes disclosed in the above-mentioned publications contains additional elements other than the tobacco materials and paper. Those additional elements change the cigarettes' original aroma and flavor to a large degree when the cigarettes are smoked, although the cigarettes are articles of taste. Hence, smokers do not like cigarettes of the above-mentioned types. Also, the additional elements increase the cigarette production cost to a large degree.

DISCLOSURE OF THE INVENTION

An object of the invention is to provide a low ignition propensity cigarette which, when smoked, maintains the cigarette's original aroma and flavor and has a low ignition propensity, and which can avoid a large increase in production cost.

In order to achieve the above object, a low ignition propensity cigarette according to the invention comprises a paper tube having an axis; a high-density region formed of shred tobacco filled in the paper tube to a first filling density, and extending along the axis of the paper tube; and a low-density region formed of second shred tobacco filled in the paper tube to a second filling density which is lower than the first filling density, the low-density region being arranged separately from the high-density region; wherein the low-density region has a part which lies between a lower part of the paper tube and the high-density region when the cigarette is in a free lying position.

Let us suppose that the cigarette in an ignited state falls and lies on a combustible object such as a floor. In this case, even if free combustion of the cigarette continues, the amount of heat generated in the low-density region per unit time and unit volume is smaller than the amount of heat generated in the high-density region per unit time and unit volume. This means that when the cigarette is in free combustion, the heat flux transmitted to the paper tube is small. As a result, rise in the temperature of that part of the paper tube which lies between the above-defined part of the low-density region and the combustible object is held down, and hence, the possibility that the above-mentioned part of the paper tube will be ignited is low. Thus, the risk of the combustible object being ignited by the ignited cigarette is held down or eliminated.

In order to maintain the aroma and flavor of the cigarette when the cigarette is smoked, it is desirable that the first filling density of the high-density region should be in the range of 0.15 to 0.35 g/cm$^3$. When the second filling density of the low-density region is in the range of 0.05 to 0.15 g/cm$^3$, the low-density region can prevent the ignited cigarette from igniting the combustible object, satisfactorily. In this case, it is desirable that the above-defined part of the low-density region should have a thickness of 1 to 3 mm.

Specifically, the high-density region can be formed of normal shred tobacco, while the low-density region can be formed of expanded shred tobacco.

The high-density region can form a core located in the center of the paper tube, while the low-density region can be located between the high-density region and the paper tube and form a sleeve surrounding the high-density region. In this case, the low-density region has, between the paper tube and the core, a thickness of 1 to 3 mm or a thickness corresponding to ¼ to ¾ of the radius of the paper tube.

In the cigarette as described above, the low-density region covers the entire inner circumference of the paper tube. Hence, even if any part of the outer circumferential surface of the cigarette touches a combustible object when the cigarette is in free combustion, ignition of the combustible object is avoided.

As stated above, when the cigarette is in free combustion, the amount of heat generated in the low-density region is small, and the low-density region also functions as a heat insulating layer for preventing transfer of heat from the high-density region. Hence, it is better that the low-density region has a larger thickness.

However, if the thickness of the low-density region is too large, it leads to deterioration in the original aroma and flavor of the cigarette when the cigarette is smoked. Hence, the thickness of the low-density region should be so determined that the aroma and flavor of the cigarette can be maintained and that the cigarette can have a satisfactorily low ignition propensity.

Specifically, when the average shred-tobacco filling density of the low ignition propensity cigarette as a whole is almost equal to the shred-tobacco filling density of the normal cigarette, the low ignition propensity cigarette has no negative effect on aroma and flavor when smoked.

The high-density region can form a tubular core. In this case, a second low-density region similar to the above-mentioned low-density region can be formed inside the core.

The high-density region can comprise a pair of cores. These cores can be obtained by dividing the tubular core.

The paper tube as well as the high-density region may have a flattened shape.

BEST MODE OF CARRYING OUT THE INVENTION

Figure 1:
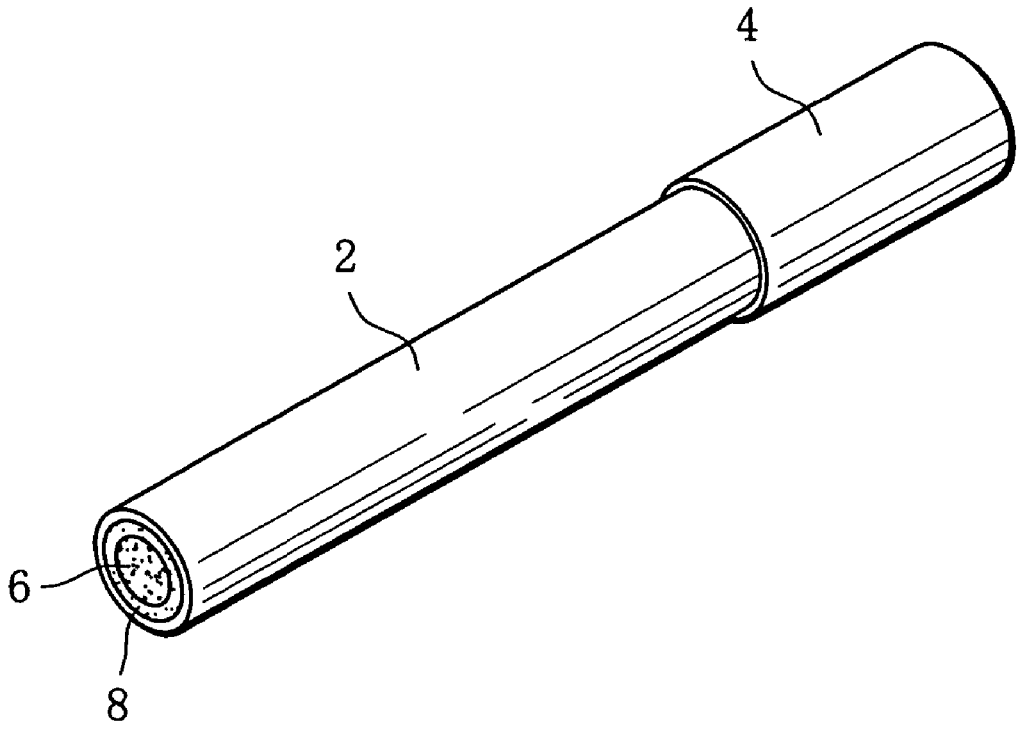
FIG. 1 is a perspective view of a low ignition propensity cigarette according to a first embodiment.
Figure 2:
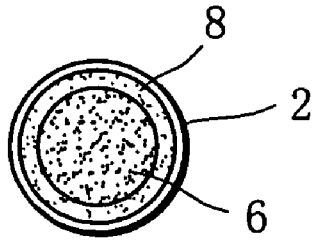
FIG. 2 is an illustration showing an end face of the cigarette of FIG. 1.

FIGS. 1 and 2 show a low ignition propensity cigarette according to a first embodiment. The cigarette comprises a paper tube 2, tobacco filler in the paper tube 2, and a filter tip 4 joined to an end of the paper tube 2. The tobacco filler includes smokable tobacco materials.

The tobacco filler forms a double concentric circle structure having a core-like high-density region 6 located in the center and a sleeve-like low-density region 8 located outside the high-density region 6. The high-density region 6 is circular in cross section, and extends in the axial direction of the paper tube 2 over the entire length of the paper tube 2. The low-density region 6 is located between the paper tube 2 and the high-density region 6, extends over the entire length of the high-density region 6 and surrounds the high-density region 6. Hence, as viewed in the cross section of the cigarette, the low-density region 8 forms an annular rim layer which is in contact with the entire inner circumferential surface of the paper tube 2 and surrounds the high-density region 6.

More specifically, the high-density region 6 contains shred tobacco which does not include expanded shred tobacco used in a normal cigarette. The shred-tobacco filling density of the high-density region 6 is, for example in the range of 0.15 to 0.35 g/cm$^3$, more specifically 0.25 g/cm$^3$.

The low-density region 8 contains expanded shred tobacco, and the expanded-shred-tobacco filling density of the low-density region 8 is in the range of 0.05 to 0.15 g/cm$^3$, for example 0.14 g/cm$^3$. The average shred-tobacco filling density of the whole including the high-density region 6 and the low-density region 8 is, for example in the range of 0.12 to 0.26 g/cm$^3$, preferably in the range of 0.17 to 0.22 g/cm$^3$.

It is desirable that the thickness of the low-density region 8 should be in the range of 1 to 3 mm, or in other words ¼ to ¾ of the radius of the paper tube 2.

Here, the expanded shred tobacco is obtained by expanding normal shred tobacco using, for example a processing system disclosed in Japanese Unexamined Patent Publication No. hei 1-104152. The expanded shred tobacco has larger expansion volume than the normal shred tobacco. Here, the expansion volume is expressed in terms of the apparent volume per unit weight.

Thus, when the expanded shred tobacco and the normal shred tobacco are made into cigarettes by a cigarette manufacturing machine under the same conditions, the expanded-shred tobacco filling density is in a lower range than the normal-shred-tobacco filling density, namely in the above-mentioned range of 0.05 to 0.15 g/cm$^3$.

Figure 3:
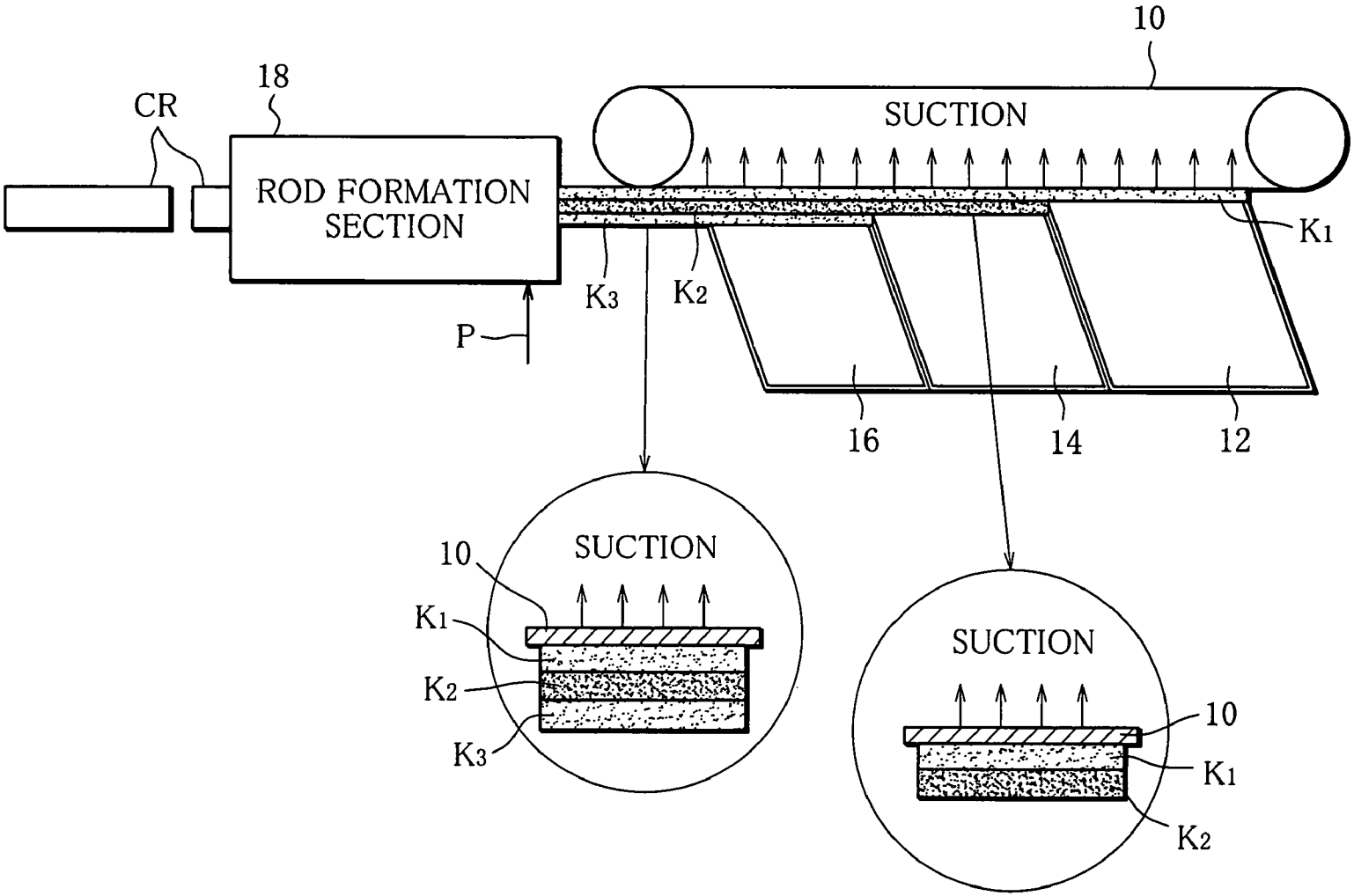
FIG. 3 is a schematic illustration showing a cigarette manufacturing machine for manufacturing the cigarette of FIG. 1.

The above-described cigarette can be manufactured by a cigarette manufacturing machine shown in FIG. 3. The manufacturing machine of FIG. 3 is different from a normal cigarette machine only in that there are provided three chimneys for supplying shred tobacco onto a tobacco band 10. Specifically, the manufacturing machine of FIG. 3 has chimneys 12, 14 and 16 under the tobacco band 10. These chimneys are arranged in the direction of travel of the tobacco band 10 in a tandem arrangement.

The rearward chimney 12 blows up expanded shred tobacco as mentioned above toward the undersurface of the tobacco band 10, so that the expanded shred tobacco is sucked onto the undersurface of the tobacco band 10 and forms a low-density layer K1.

Next, the chimney 14 blows up normal shred tobacco toward the low-density layer K1 on the tobacco band 10. As a result, the normal shred tobacco is sucked onto the low-density layer K1 and forms a high-density layer K2 covering the low-density layer K1.

Last, the forward chimney 16 blows up expanded shred tobacco toward the undersurface of the tobacco band 10. The expanded shred tobacco blown up here is sucked onto the high-density layer K2 and forms a low-density layer K3 covering the high-density layer K2. Thus, the layered shred tobacco consisting of the layers K1, K2 and K3 is obtained on the undersurface of the tobacco band 10.

Here, when the individual widths of the layers K1, K2 and K3 are expressed as W1, W2 and W3, the relationship W1<W2<W3 is satisfied. Hence, the blowing widths of the chimneys 12, 14 and 16 which are open towards the undersurface of the tobacco band 10 are increased in this order, stepwise.

Then, when the above-described layered shred tobacco is supplied from the tobacco band 10 to a rod formation section 18, the layered shred tobacco is transferred onto paper P. Here, the layered shred tobacco on the paper P has an arrangement that the layers K3, K2 and K1 are laid on the paper P in this order.

While the paper P and the layered shred tobacco pass through the rod formation section 18, the layered shred tobacco is wrapped in the paper P continuously, so that a tobacco rod is formed. Here, the tobacco rod has the high-density layer K2 in its center, and the low-density layers K1 and K3 which surround the high-density layer K2. Thus, the high-density layer K2 forms the high-density region 6, while the low-density layers K1 and K3 form the low-density region 8.

Then in the rod formation section 18, the tobacco rod is cut into individual cigarette rods CR. The cigarette rod CR is twice the length of the above-mentioned cigarette.

The cigarette rods CR made like this are supplied to a filter attachment machine (not shown). The filter attachment machine makes the cigarette shown in FIG. 1.

Let us suppose that a smoker smoking the above-described cigarette drops the cigarette on a combustible object such as a floor through his or her carelessness. Inside the paper tube 2, the low-density region 8 is lower in shred-tobacco filling density than the high-density region 6. Hence, even when free combustion of the cigarette continues, the amount of heat generated in the low-density region 8 per unit time and unit volume is smaller than the amount of heat generated in the high-density region 6 per unit time and unit volume. Thus, the paper tube 2 is not heated to high temperature. Further, the low-density region 8 prevents the heat generated in the high-density region 6 from transferring to the paper tube 2, and functions as a heat insulating layer. Hence, even when the cigarette continues free combustion on the combustible object, the possibility that that part of the paper tube 2 which touches the combustible object will be ignited is low. Thus, the risk of the combustible object being ignited is held down.

Further, when a smoker smokes the cigarette, he or she mainly draws in mainstream smoke produced by combustion of the high-density region 6. Hence, the cigarette according to the present invention is not much different in aroma and flavor from the normal cigarette.

Further, the cigarette according to the present invention does not contain any other elements than those used in the normal cigarette. Hence, the cigarette according to the invention can be manufactured by the normal cigarette manufacturing machine if only the chimney of the normal cigarette machine is replaced with the above-described chimneys 12 to 16. Thus, the production cost does not increase to a large degree.

Table 1 below shows free combustion speed and ignition ratio in cigarettes A to D as comparative examples, and cigarettes E to G (examples) according to the present invention. The free combustion speed is an indicator which affects the aroma and flavor of a cigarette, while the ignition ratio is an indicator of the ignition propensity of a cigarette.

TABLE 1

| | Ratio of high-density region (%) | Ratio of low-density region (%) | Arrangement | Average filling density (g/cm$^3$) | Free combustion speed (mm/min) | Thickness of thinnest part of low-density region in contact with paper tube (mm) | Ignition ratio(%) |
|---|---|---|---|---|---|---|---|
| A | 70 | 30 | — | 0.22 | 4.40 | — | 100 |
| B | 50 | 50 | — | 0.20 | 4.59 | — | 83 |
| C | 0 | 100 | — | 0.14 | 5.94 | 4.00 | 0 |
| D | 70 | 30 | Reverse concentric | 0.22 | 4.19 | — | 100 |
| E | 70 | 30 | Normal concentric | 0.22 | 4.65 | 0.25 | 67 |
| F | 50 | 50 | Normal concentric | 0.20 | 4.92 | 1.00 | 0 |
| G | 30 | 70 | Normal concentric | 0.17 | 5.15 | 2.00 | 0 |

Any of the comparative examples and examples A to G in table 1 is a tubular cigarette of 24.8 mm in circumference, about 8 mm in diameter and 85 mm in length. The shred-tobacco filling densities of the high-density region and the low-density region are 0.25 g/cm$^3$ and 0.14 g/cm$^3$, respectively.

Regarding the "arrangement" in table 1, "normal concentric" indicates the concentric structure where the high-density region 6 is located in the center of the paper tube 2 and the low-density region 8 is located outside the high-density region 6 as shown in FIG. 2. "Reverse concentric" indicates the structure where the arrangement of the high-density region 6 and the low-density region 8 is reversed. The mark "-" represents the state where the normal shred tobacco which forms the high-density region 6 and the expanded shred tobacco which forms the low-density region 8 are mixed, namely the tobacco filler of the normal cigarette.

The "free combustion speed" in table 1 is the value measured when the cigarette is laid in a windless state and left in free combustion.

The "ignition ratio" in table 1 is the value obtained employing the Mock-up Ignition Method which was reported in NIST in the United States.

NIST is the abbreviation for National Institute of Standards and Technology. The source of the Mock-up Ignition Method is: Ohlemiller, T. J., Villa, K. M., Braun, E., Eberhardt, K. R., Harris, Jr., Lawson, J. R., and Gann, R. G., "Test Methods for Quantifying the Propensity of Cigarettes to Ignite Soft Furnishing", NIST Special Publication 851.

Specifically, the "ignition ratio" is the ratio of those cigarettes which ignited #6 cotton fabric as test fabric when 48 of cigarettes were ignited and laid on the #6 cotton fabric.

As obvious from table 1, the cigarettes as examples E to G have free combustion speed similar to that of the cigarettes as comparative examples A, B and D. This means that the former have aroma and flavor similar to that of the latter. Nevertheless, the cigarettes as examples E to G have ignition ratio lower than that of the cigarettes as comparative examples A, B and D. This means that the ignition propensity of examples E to G is lower than that of comparative examples A, B and D. Particularly when the low-density region 8 in contact with the inner circumference of the paper tube 2 has a thickness of 1 mm or larger, the risk of the ignited cigarette igniting a combustible object can be kept very low.

Though a cigarette as comparative example C has an ignition ratio of 0%, it has a very high free combustion speed. Hence, the cigarette as comparative example C is much inferior in aroma and flavor to the normal cigarette, and unfit for smoking.

The present invention is not limited to the above-described first embodiment. A variety of modifications can be made.

Figure 4:
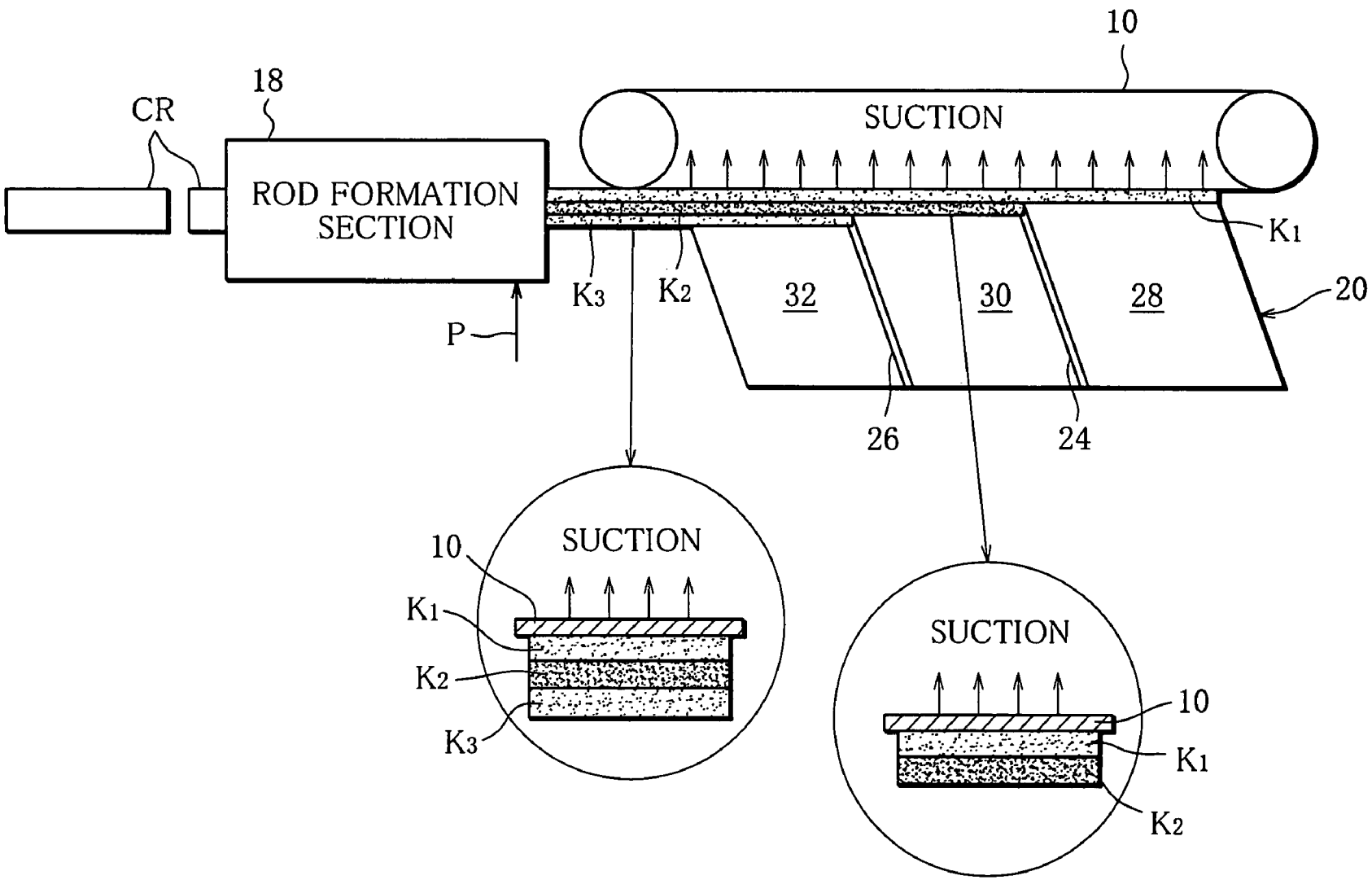
FIG. 4 is a schematic illustration showing another cigarette manufacturing machine for manufacturing the cigarette of FIG. 1.

A cigarette manufacturing machine in FIG. 4 has a single chimney 20 for supplying shred tobacco to a tobacco band 10. The chimney 20 has, however, two partition walls 24 and 26 inside, and the partition walls 24 and 26 divide the inside of the chimney 20 into three chambers 28, 30 and 32. These chamber 28, 30 and 32 correspond to the chimneys 12, 14 and 16, respectively. Thus, the widths of the blowing openings of the chambers 28, 30 and 32 are increased in this order, stepwise.

As in the cigarette manufacturing machine of FIG. 3, in the cigarette manufacturing machine of FIG. 4, layered shred tobacco consisting of layers K1, K2 and K3 are formed on the undersurface of the tobacco band 10. Thus, the cigarette manufacturing machine of FIG. 4 can make a tobacco rod from which the cigarette of FIG. 1 is made.

Figure 5:
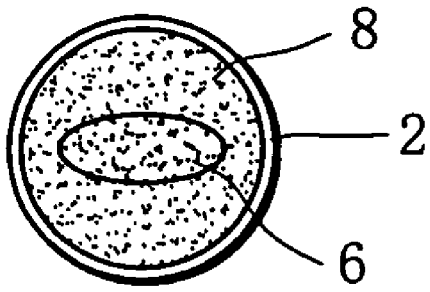
FIG. 5 is an illustration showing an end face of a low ignition propensity cigarette according to a second embodiment.

A cigarette according to a second embodiment shown in FIG. 5 has a high-density region 6 which is elliptic in cross section. In this case, an annular low-density region 8 has a thickness of at least 1 mm at its thinnest part.

Figure 6:
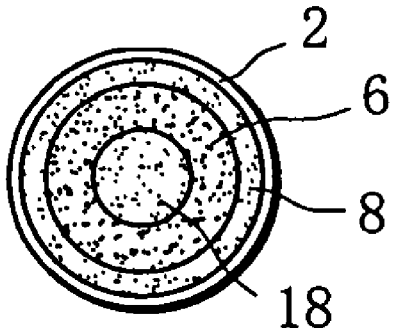
FIG. 6 is an illustration showing an end face of a low ignition propensity cigarette according to a third embodiment.

A cigarette according to a third embodiment shown in FIG. 6 has a tubular high-density region 6, and includes another low-density region 34 inside the high-density region 6.

Figure 7:
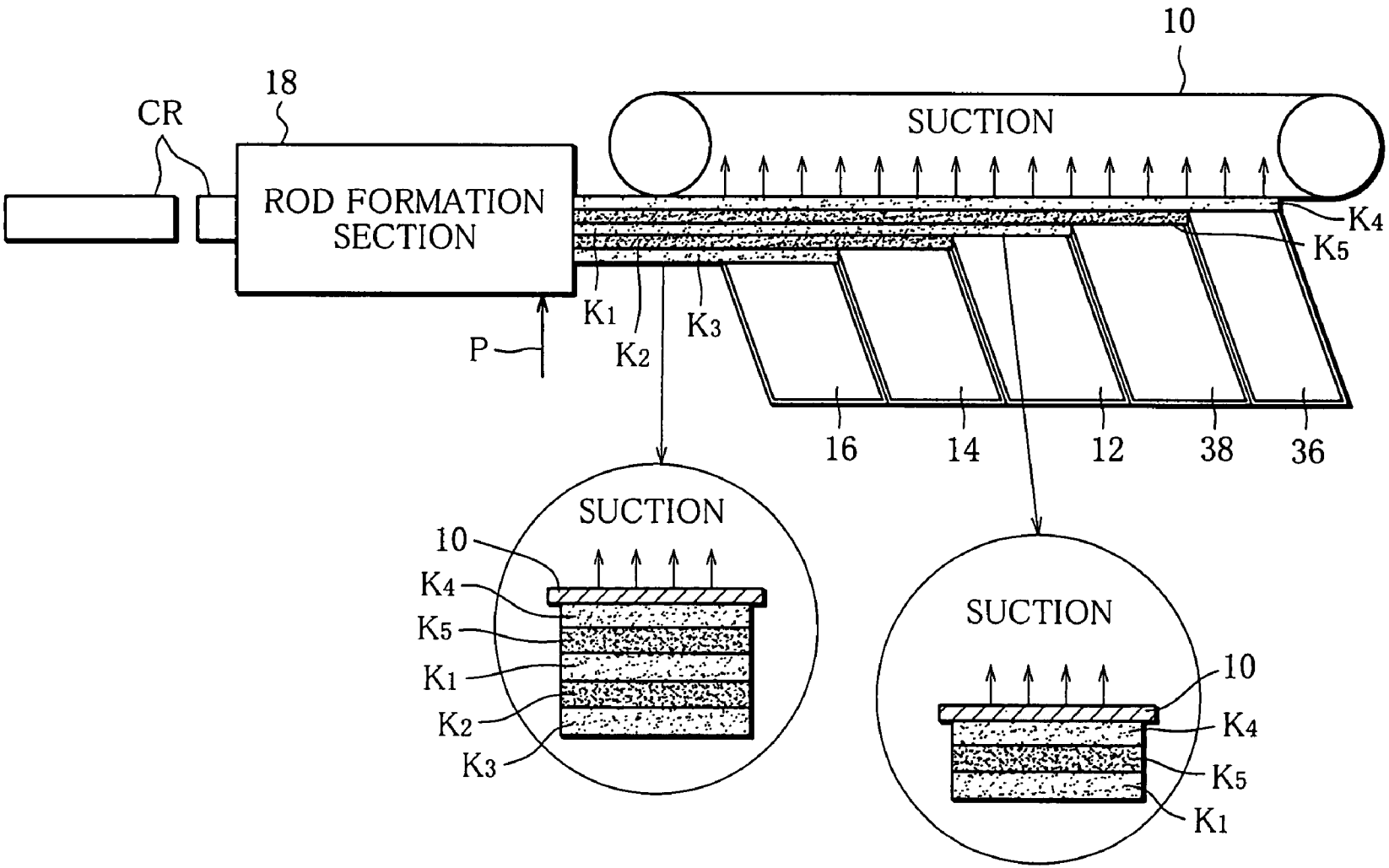
FIG. 7 is a schematic illustration showing a cigarette manufacturing machine for manufacturing the cigarette of FIG. 6.

The cigarette of FIG. 6 can be manufactured by a cigarette manufacturing machine shown in FIG. 7.

The manufacturing machine of FIG. 7 is obtained by adding further two chimneys 36 and 38 to the cigarette manufacturing machine of FIG. 3. These chimneys 36 and 38 are arranged upstream the chimney 12, and form a low-density layer K4 of expanded shred tobacco and a high-density layer K5 of normal shred tobacco on the undersurface of the tobacco band 10 in this order.

Figure 8:
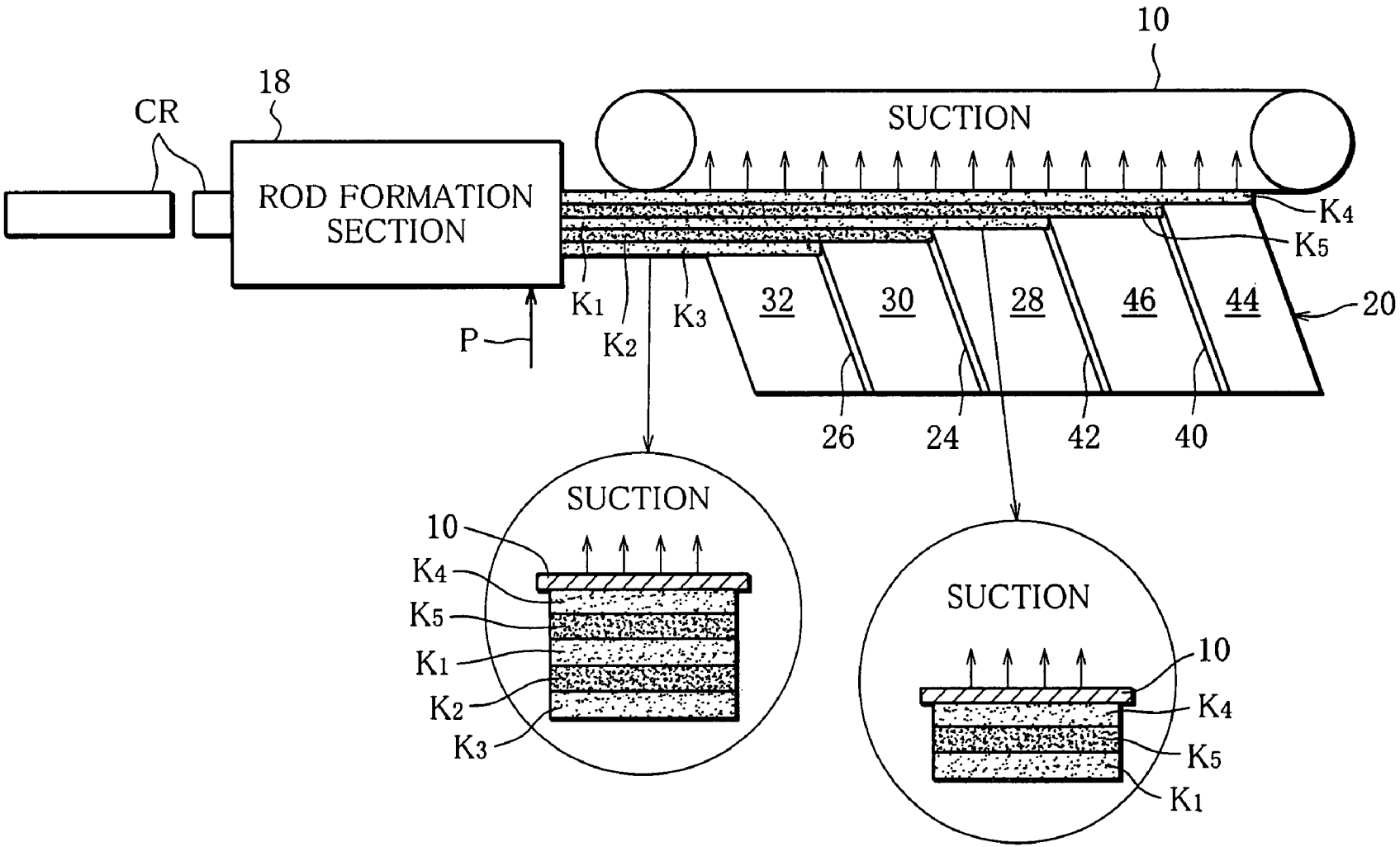
FIG. 8 is a schematic illustration showing another cigarette manufacturing machine for manufacturing the cigarette of FIG. 6.

The cigarette of FIG. 6 can be also manufactured by a cigarette manufacturing machine shown in FIG. 8. The manufacturing machine of FIG. 8 is obtained by further partitioning the inside of the chimney 20 of the cigarette manufacturing machine of FIG. 4 using partition walls 40 and 42. The partition walls 40 and 42 add chambers 44 and 46 upstream the chamber 28. Like the above-mentioned chimneys 36 and 38, the chambers 44 and 46 form a low-density layer K4 and a high-density layer K5 on the undersurface of the tobacco band 10 in this order.

Figure 9:
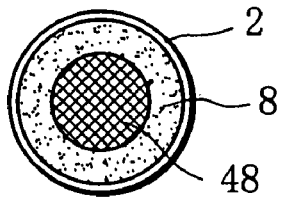
FIG. 9 is an illustration showing an end face of a low ignition propensity cigarette according to a fourth embodiment.

A cigarette according to a fourth embodiment shown in FIG. 9 has a high-density region 48 in the center of a paper tube 2. The high-density region 48 is formed of a mixture of expanded shred tobacco and normal shred tobacco. The shred-tobacco filling density of the high-density region 48 is higher than that of a low-density region 8. The high-density region 48 of this type can be used as the high-density region 6 in the other embodiments.

Figure 10:
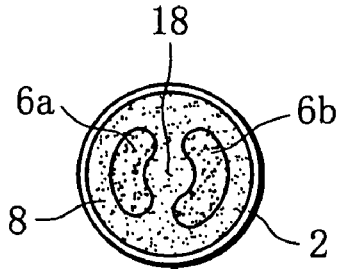
FIG. 10 is an illustration showing an end face of a low ignition propensity cigarette according to a fifth embodiment.

FIG. 10 shows a cigarette according to a fifth embodiment. The cigarette of FIG. 10 has a pair of high-density regions 6*a*, 6*b*. These high-density regions 6*a*, 6*b* are obtained by dividing the annular high-density region 6 of FIG. 6.

The cigarette of FIG. 10 can be manufactured by the cigarette manufacturing machine of FIG. 7 or that of FIG. 8. In this case, the widths of the high-density layers K5 and K2 formed on the undersurface of the tobacco band 10 in this order are smaller than those in the case where the cigarette of FIG. 6 is manufactured. These high-density layers K5 and K2 form the high-density regions 6*a* and 6*b*, respectively.

Figure 11:
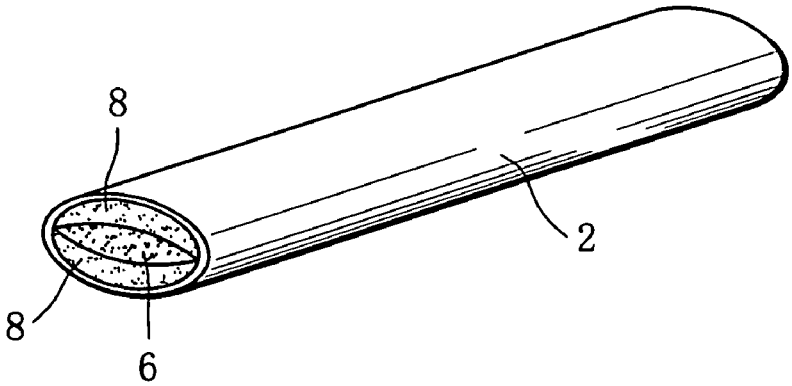
FIG. 11 is an illustration showing an end face of a low ignition propensity cigarette according to a sixth embodiment.

FIG. 11 shows a cigarette according to a sixth embodiment. A paper tube 2 of the cigarette of FIG. 11 is elliptic in cross section. In this case, a high-density region 6 forms a flattened core which is elliptic in cross section. As viewed in the elliptic cross section of the paper tube 2, the flattened core extends along the long axis of the ellipsis from one side of the inner circumference of the paper tube 2 to the other side. A low-density region 8 is arranged to hold the high-density region 6 on both sides, or in other words, the high-density region 6 divides the low-density region 8 into a pair of outside layers.

In order to manufacture the cigarette of FIG. 11, layered shred tobacco consisting of layers K1, K2 and K3 is first formed on the undersurface of a tobacco band 10. Then, in a rod formation section 18, the layered shred tobacco is formed into a flattened tobacco rod using paper P. Alternatively, after the layered shred tobacco is formed into a tobacco rod of a circular cross section using paper P, the tobacco rod is flattened In the cigarette of FIG. 11, the opposite ends of the high-density region 6 are in contact with the inner circumference of the paper tube 2. However, even when the flattened cigarette is dropped on a combustible object such as a floor through carelessness, the flattened cigarette comes to lie on the combustible object in the position shown in FIG. 11. Thus, between the combustible object and the high-density region 6 always exists the low-density region 8. Hence, the risk of the combustible object being ignited is reduced effectively.

It is to be noted that also to the cigarette of FIG. 11, a filter tip (not shown) can be fitted.

The invention claimed is:

1. A low ignition propensity cigarette comprising:

a paper tube having an axis, a core region formed of shred tobacco filled in said paper tube to a first filling density, and extending along the axis, and a hollow cylinder-shaped heat insulating region formed of second shred tobacco filled in the paper tube to a second filling density which is lower than the first filling density, said heat insulating region being arranged separately from a core region, wherein said heat insulating region includes an inner cylindrical-shaped surface which is disposed in direct contact with an outer cylindrical-shaped surface of said core region, and an outer cylindrical-shaped surface which is disposed in direct contact with an inner surface of the paper tube, and when the cigarette is lying with a long axis thereof parallel to a surface on which the cigarette rests, said heat insulating region has a part which lies between a lower part of said paper tube and said core region, the lower part of said paper tube being in contact with the surface, wherein the first filling density of said core region is in a range of 0.15 to 0.35 g/cm$^3$, and the second filling density of said heat insulating region is in a range higher than or equal to 0.05 g/cm$^3$ and lower than 0.14 g/cm$^3$, and wherein said part of said heat insulating region has a thickness of 1 to 3 mm, wherein said core region is made of normal shred tobacco from which expanded shred tobacco is excluded, while said heat insulating region is made of the expanded shred tobacco.

2. The cigarette according to claim 1, wherein said core region is located in a center of said paper tube, while said heat insulating region is located between said core region and said paper tube and forms a sleeve surrounding said core region.

3. The cigarette according to claim 2, wherein said heat insulating region has a thickness corresponding to ¼ to ¾ of a radius of said paper tube between said paper tube and said core.

4. The cigarette according to claim 1, wherein said core region forms a high-density tube located in a center of said paper tube, while said heat insulating region has a first portion located between said high-density tube and said paper tube, the first portion forming a sleeve surrounding said high-density tube, and a second portion filling inside said high-density tube.

5. The cigarette according to claim 1, wherein said core region has a pair of high-density layers separated from each other, and said heat insulating region fills inside said paper tube so as to surround said high-density layers.

6. The cigarette according to claim 1, wherein said paper tube is elliptic in cross section, said core region forms a flattened core which, as viewed in cross section, extends along a long axis of the ellipse, from one side of an inner circumference of said paper tube to the other side thereof, and said heat insulating region forms a pair of outside layers which hold said flattened core between.

7. The cigarette according to claim 1, wherein the first filling density of said core region is 0.35 g/cm$^3$.

8. The cigarette according to claim 1, wherein each of the core region and the heat insulating region has a cross-sectional area which remains constant along an entire length thereof, the lengths of the core region and the heat insulating area being the same.

9. The cigarette according to claim 1, wherein a whole of said core and heating regions has an average filling density of 0.12 to 0.26 g/cm$^3$.

10. A low ignition propensity cigarette comprising:

a paper tube, a heat insulating region having an outer cylindrical-shaped surface making direct contact along its entire length with an inner surface of the paper tube, one or more core regions embedded within the heat insulating region and extending along the entire length of the heat insulating region, such that the heat insulating region surrounds and make direct contact with an outer surface of each of the one or more core regions, wherein a filling density of said core region is in a range of 0.15 to 0.35 g/cm$^3$, a filling density of said heat insulating region is in a range higher than or equal to 0.05 g/cm$^3$ and lower than 0.14 g/cm$^3$, wherein said core region is made of normal shred tobacco from which expanded shred tobacco is excluded, while said heat insulating region is made of the expanded shred tobacco, wherein a thickness of the heat insulating is an a range of 1 to 3 mm, such that the paper tube is separated from each of the one or more core regions by a thickness of at least 1 mm, wherein when the cigarette is lying with a long axis thereof parallel to a surface on which the cigarette rests, said heat insulating region, lies between a lower part of said paper tube and said core region, the lower part of said paper tube being in contact with the surface, thereby reducing the possibility that the lit cigarette will cause combustion of the surface on which it rests.

11. The cigarette according to claim 10, wherein the first filling density of said core region is 0.35 g/cm$^3$.

12. The cigarette according to claim 10, wherein each of the one or more core regions and the heat insulating region has a cross-sectional area which remains constant along an entire length thereof, the lengths of the core region and the heat insulating area being the same.

13. The cigarette according to claim 10, wherein the one or more core regions are two core regions, each of which is off-set with respect to an axis of the heat insulating region.

14. The cigarette according to claim 10, wherein a whole of said core and heating regions has an average filling density of 0.12 to 0.26 g/cm$^3$.

* * * * *